US009839257B2

(12) United States Patent
Fransko, Sr.

(10) Patent No.: US 9,839,257 B2
(45) Date of Patent: Dec. 12, 2017

(54) FLEXIBLE SKATEBOARD SHOE PROTECTOR OVERSHOE

(71) Applicant: Michael Edward Fransko, Sr., Millville, NJ (US)

(72) Inventor: Michael Edward Fransko, Sr., Millville, NJ (US)

( * ) Notice: Subject to any disclaimer, the term of this patent is extended or adjusted under 35 U.S.C. 154(b) by 81 days.

(21) Appl. No.: 14/873,874

(22) Filed: Oct. 2, 2015

(65) Prior Publication Data

US 2017/0071282 A1 Mar. 16, 2017

Related U.S. Application Data

(60) Provisional application No. 62/219,221, filed on Sep. 16, 2015.

(51) Int. Cl.

| | |
|---|---|
| ***A43B 1/10*** | (2006.01) |
| ***A43B 13/22*** | (2006.01) |
| ***A43B 3/16*** | (2006.01) |
| ***A43B 5/18*** | (2006.01) |
| ***A43B 3/26*** | (2006.01) |

(52) U.S. Cl.

CPC ..... *A43B 5/18* (2013.01); *A43B 3/16* (2013.01); *A43B 3/26* (2013.01)

(58) Field of Classification Search

CPC .. A43B 5/18; A43B 3/26; A43B 5/185; A43B 5/16; A43C 13/00

See application file for complete search history.

(56) References Cited

U.S. PATENT DOCUMENTS

| | | | | |
|---|---|---|---|---|
| 228,769 | A | 6/1880 | Mayall | |
| 1,465,504 | A | 8/1923 | Weigand | |
| 2,032,793 | A | 3/1936 | Clark | |
| 2,068,238 | A | 1/1937 | Malm | |
| 2,281,321 | A | 4/1942 | Olson | |
| 3,250,025 | A | 5/1966 | Crescent | |
| 3,724,107 | A | 4/1973 | Makinen | |
| 4,010,558 | A | 3/1977 | Slusher | |
| 4,160,331 | A | 7/1979 | Bell | |
| 4,434,565 | A | 3/1984 | Haley | |
| 4,693,019 | A | 9/1987 | Kim | |
| 4,713,895 | A | 12/1987 | Vallieres | |
| 4,780,970 | A | 11/1988 | McArthur, Sr. | |
| 4,825,563 | A | 5/1989 | Strongwater | |
| D319,140 | S | 8/1991 | Hernandez | |
| 5,165,182 | A | 11/1992 | Michael | |
| 5,251,386 | A | 10/1993 | Diaz | |
| 5,315,767 | A * | 5/1994 | Bradbury | A43B 3/16 36/135 |

(Continued)

*Primary Examiner* — Jila M Mohandesi
(74) *Attorney, Agent, or Firm* — Dale J. Ream

(57) ABSTRACT

A flexible one size fits all overshoe that is placed over the shoe which covers all areas of the shoe damaged during skateboarding. This overshoe is made of a flexible material that conforms to the shoe in all areas in order to protect area of the shoe. This can be one or a combination of pieces to create the overshoe. The overshoe adds additional cushioning and traction to the heel and ball of the shoe. The mid foot of the overshoe is constructed in a way to allow stretching to fit and conform to an extremely broad range of shoe sizes. The upper and the sole also has added traction in the form of raised areas to allow the "grip" of the shoe to the skateboard for the efficient execution of tricks and stunts.

9 Claims, 5 Drawing Sheets

(56) References Cited

U.S. PATENT DOCUMENTS

| | | | | |
|---|---|---|---|---|
| D353,707 | S | 12/1994 | Puff | |
| 5,396,717 | A | 3/1995 | Bell | |
| 5,548,910 | A * | 8/1996 | Klingseis | A43B 5/185 36/135 |
| 5,778,564 | A | 7/1998 | Kettner | |
| D413,711 | S | 9/1999 | Hicks, Jr. | |
| 5,996,258 | A | 12/1999 | Simmons | |
| 6,836,977 | B2 * | 1/2005 | Larson | A43B 3/16 36/59 R |
| 6,988,328 | B2 | 1/2006 | Rosen | |
| 7,021,663 | B1 * | 4/2006 | Moran | A43B 5/18 280/11.12 |
| 7,188,438 | B1 * | 3/2007 | Bowen | A43B 3/18 36/138 |
| 7,383,646 | B2 | 6/2008 | Hall | |
| D619,338 | S | 7/2010 | Teichert | |
| D619,339 | S | 7/2010 | Teichert | |
| D639,031 | S | 6/2011 | Smith | |
| 8,225,529 | B2 * | 7/2012 | Simms | A43B 5/185 36/135 |
| 8,453,355 | B2 | 6/2013 | Kay | |
| 8,701,310 | B1 * | 4/2014 | Walsh | A43B 3/16 36/7.2 |
| D727,000 | S | 4/2015 | Malkin | |
| 2004/0074113 | A1 * | 4/2004 | Kim | A43C 11/06 36/135 |
| 2005/0022430 | A1 | 2/2005 | Terry | |
| 2005/0229428 | A1 | 10/2005 | Holcomb | |
| 2007/0113424 | A1 * | 5/2007 | Bell | A43B 3/16 36/7.3 |
| 2009/0083993 | A1 * | 4/2009 | Plank | A43B 3/0078 36/7.3 |
| 2010/0325922 | A1 | 12/2010 | Takahashi | |
| 2011/0047829 | A1 * | 3/2011 | Bell | A43B 5/18 36/134 |
| 2014/0020267 | A1 | 1/2014 | Perez | |
| 2014/0325875 | A1 | 11/2014 | Lee | |

* cited by examiner

FLEXIBLE SKATEBOARD SHOE PROTECTOR OVERSHOE

RELATED APPLICATIONS

The present application is a continuation-in-part application of U.S. provisional patent application, Ser. No. 62/219,221, filed Sep. 16, 2015, for SKATEBOARD SHOE PROTECTOR SOCK OVERSHOE, by Michael E Fransko Sr, included by reference herein and for which benefit of the priority date is hereby claimed.

The present application is related to United States patent number 2010/0325922, issued Jun. 28, 2010, for SHOE PROTECTOR FOR SKATEBOARDING APPLICATIONS, included by reference herein.

The present application is related to United States patent number 2009/0083993, issued Oct. 1, 2007, for REMOVABLE SHOE COVER, included by reference herein.

The present application is related to United States patent number 2014/0020267, issued Jul. 18, 2012, for SKATE SHOE GRIP PAD, included by reference herein.

The present application is related to U.S. Pat. No. D639,031 S, issued Oct. 18, 2010, for SKATEBOARD SHOE PROTECTION DEVICE, included by reference herein.

The present application is related to United States patent number 2005/0022430, issued Feb. 3, 2005, for PROTECTIVE SHOE COVERING FOR ATHLETIC SHOES, included by reference herein.

The present application is related to U.S. Pat. No. 4,825,563, issued May 2, 1989, for SHOE PROTECTOR, included by reference herein.

The present application is related to U.S. Pat. No. 4,780,970, issued Nov. 1, 1988, for SHOE PROTECTOR, included by reference herein.

The present application is related to U.S. Pat. No. 5,251,386, issued Oct. 12, 1993, for PROTECTIVE COVER FOR SHOES, BOOTS AND THE LIKE, included by reference herein.

The present application is related to U.S. Pat. No. 5,996,258, issued Dec. 7, 1999, for PROTECTIVE SHOE COVER, included by reference herein.

The present application is related to U.S. Pat. No. 4,713,895, issued Dec. 22, 1987, for SPORTS SHOE COVER, included by reference herein.

The present application is related to United States patent number 2005/0229428 A1, issued Apr. 3, 1973, for STOWABLE OVERSHOES TRACTION SOLES, included by reference herein.

The present application is related to U.S. Pat. No. 3,724,107, issued Apr. 3, 1973, for ELASTIC OVERSHOES, included by reference herein.

The present application is related to U.S. Pat. No. 2,068,238, issued Jan. 19, 1937, for FLEXIBLE RUBBER OVERSHOE, included by reference herein.

The present application is related to U.S. Pat. No. 2,281,321, issued Apr. 28, 1942, for OVERSHOE, included by reference herein.

The present application is related to U.S. Pat. No. 1,465,504, issued Aug. 21, 1923, for RUBBER FOOTWEAR, included by reference herein.

The present application is related to U.S. Pat. No. D727,000 S, issued Apr. 21, 2015, for SHOE COVER, included by reference herein.

The present application is related to U.S. Pat. No. 3,250,025, issued May 10, 1966, for SHOE PROTECTOR, included by reference herein.

The present application is related to U.S. Pat. No. 5,165,182, issued Nov. 24, 1992, for OPEN ENDED SHOE COVER, included by reference herein.

The present application is related to U.S. Pat. No. 228,769, issued Jun. 15, 1880, for RUBBER OVERSHOE, included by reference herein.

The present application is related to U.S. Pat. No. Des. 413,711, issued Sep. 14, 1999, for ATHLETIC SHOE COVERING, included by reference herein.

The present application is related to U.S. Pat. No. 5,396,717, issued Mar. 14, 1995, for CONVERTIBLE OVERSHOE WITH TEAR RESISTANT BEAD, included by reference herein.

The present application is related to U.S. Pat. No. Des. 353,707, issued Dec. 27, 1994, for ATHLETIC CHOE RUBBER, included by reference herein.

The present application is related to U.S. Pat. No. 4,160,331, issued Jul. 10, 1979, for OUTER SHOE WITH GRIPPING SURFACE, included by reference herein.

The present application is related to U.S. Pat. No. 5,315,767, issued May 31, 1994, for SHOE SOLE SAVER, included by reference herein.

The present application is related to United States patent number 2014/0325875, issued Nov. 6, 2014, for ATTACHABLE SHOE SOLE PROTECTOR, included by reference herein.

The present application is related to U.S. Pat. No. 7,383,646 B2, issued Jun. 10, 2008, for ATHLETIC SHOE COVER, included by reference herein.

The present application is related to United States patent number 2004/0074113 A1, issued Apr. 22, 2004, for PROTECTIVE COVER FOR CLEAT SHOE, included by reference herein.

The present application is related to U.S. Pat. No. 4,434,565, issued Mar. 6, 1984, for NON-SLIP OVERSHOE, included by reference herein.

The present application is related to U.S. Pat. No. 4,010,558, issued Mar. 8, 1977, for GOLF RUBBER OVERSHOE, included by reference herein.

The present application is related to U.S. Pat. No. 2,032,793, issued Mar. 3, 1936, for GOLF OVERSHOE, included by reference herein.

The present application is related to U.S. Pat. No. D619,339, issued Jul. 13, 2010, for PROTECTIVE SPORTS SPAT FOR CLEATED OR SPIKED SHOES, included by reference herein.

The present application is related to U.S. Pat. No. 8,453,355 B2, issued Jun. 4, 2013, for COVER FOR CLEATED SHOE, included by reference herein.

The present application is related to U.S. Pat. No. 4,693,019, issued Sep. 15, 1987, for SPORTS SHOE PROTECTOR, included by reference herein.

The present application is related to U.S. Pat. No. Des 319,140, issued Aug. 20, 1991, for REMOVABLE SHOE PROTECTOR, included by reference herein.

FIELD OF THE INVENTION

The present invention relates to flexible overshoe and, more particularly, one piece flexible overshoe that protects shoes from damage caused while skateboarding.

BACKGROUND OF THE INVENTION

Skateboarding has progressed from casually riding on a skateboard to stunts, tricks and maneuvering the skateboard in many ways such as kicks, flips, jumps, spins . . . etc. This new maneuvering and riding of the skateboard has been known to cause excessive and severe damage to many areas of the rider's shoes due to the surface that the rider is on, and the manipulation of the skateboard with the rider's feet. On the top of the skateboard is "grip tape" which is essentially sandpaper. This grip tape, when it comes in comes in contact with the skateboarder's shoe during the tricks and maneuvers, adds traction to the shoe in order for the rider to perform the tricks. This grip tape also causes tearing and major wear to several areas of the shoe. The main areas of the shoe that is affected are the outside upper of the shoe, the laces of the shoe, the ball area of the sole as well as the heel and heel area of the sole. In addition, the soles of the rider's shoe is susceptible to wear from the grip tape and the hard surfaces on which the rider is skating on when his is riding and performing these tricks and stunts, for example: concrete, blacktop, hardwood etc. Within a short time, the skateboarder has worn his shoe down so much that he will need to replace the shoe because it is no longer usable or safe to use. In this day and age, a skate shoe can range in cost from $40 to over $100 per pair.

The current products on the market provide some protection of the upper Portion of the shoe, but not to the bottom of the shoe. These "patches" are affixed to the shoe with adhesive glues or other types of adhesive means. Additional prior art shows a product that protects the front area of the shoe. Another product is a type of glue or rubber cement that is applied to the area of the upper portion of the shoe that dries to form a barrier where the wear is prevalent.

The current products as stated above are semi-permanent fixes that are mostly not removable from the shoe. These products, such as the adhesive patches, cannot be removed once applied and do not last very long. They do not allow the skateboarder to wear it for any other use than to skateboard since the shoe is altered and not very visually appealing. They do not protect all areas of the shoe where damage and wear is prevalent. The glue/rubber cement product also is not removable once applied. This product takes time to dry before the rider can wear the shoes to skateboard. Although it can be placed on most areas where the damage is prevalent. It is very messy and does not provide the best protection. It is a very temporary fix to the problem. These products are not removable nor are they reusable. Other products that may be found in prior art are made to be applied due to the size of the shoe and need to be purchased using the shoe size specifically or a small range of sizes.

SUMMARY OF THE INVENTION

In accordance with the present invention, there is provided a removable and reusable flexible one size fits all overshoe that is placed over the shoe which will cover all areas of the shoe that are damaged during skateboarding. This overshoe is made of a flexible material that conforms to the shoe in all areas needed in order to protect specific portions of the shoe while conforming to the shoe's shape. This can be one piece or a combination of pieces to create the overshoe. The overshoe adds additional cushioning and traction to the heel and ball of the shoe. The middle of the overshoe is constructed in a way to allow the overshoe to be stretched to fit and conform to a very broad range of shoe sizes and not just to a few size ranges. The upper and the sole also has added traction in the form of raised areas or other forms of traction to allow the "grip" of the shoe to the skateboard for the efficient execution of tricks and stunts. The overshoe also covers the laces area on the front of the shoe protecting them from damage where it is prevalent. Once the skateboarder has finished using the product, it can be removed and saved to be reused at a later time. The construction of this overshoe is such that it can be used on any type of shoe therefore making any shoe style a "skateboarding" shoe.

It would be advantageous to provide an overshoe that will protect the upper portion of the shoe from the damage caused by contact with the grip tape.

It would also be advantageous to provide an overshoe that has added thickness and traction to the sole heel and ball portion that adds protection from the damage of the surface skated on and the grip tape of the board.

It would also be advantageous to provide an overshoe that has added thickness to the sole heel and ball portion that adds cushioning for when the skateboarder falls from the board or lands on the board after performing a stunt or trick. Thus preventing injuries to the skateboarder's feet.

It would also be advantageous to provide an overshoe that covers the lower laces area of the shoe to protect the laces from the damage of the grip tape.

It would further be advantageous to provide an overshoe that is flexible in order to conform to the shoe as to maintain the feel of the shoe and the integrity of the shape of the shoe.

It would be further advantageous to provide an overshoe that is constructed in a way that allows the overshoe to be applied to numerous size shoes without needed to search of one of a specific size for each individual skateboarder.

It would be further advantageous to provide an overshoe that is removable and reusable.

It would be further advantageous to provide an overshoe that is symmetrical so the skateboarder can wear said overshoe on either foot regardless of the form the skateboarder's uses as he skates. (regular or "goofy")

It would be further advantageous to provide a one piece design that adds to the durability of the product that resists separation of two or more pieces.

It would be further advantageous to allow this product to be put on any shoe type or style to make that shoe one that can be used to skateboard.

BRIEF DESCRIPTION OF DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
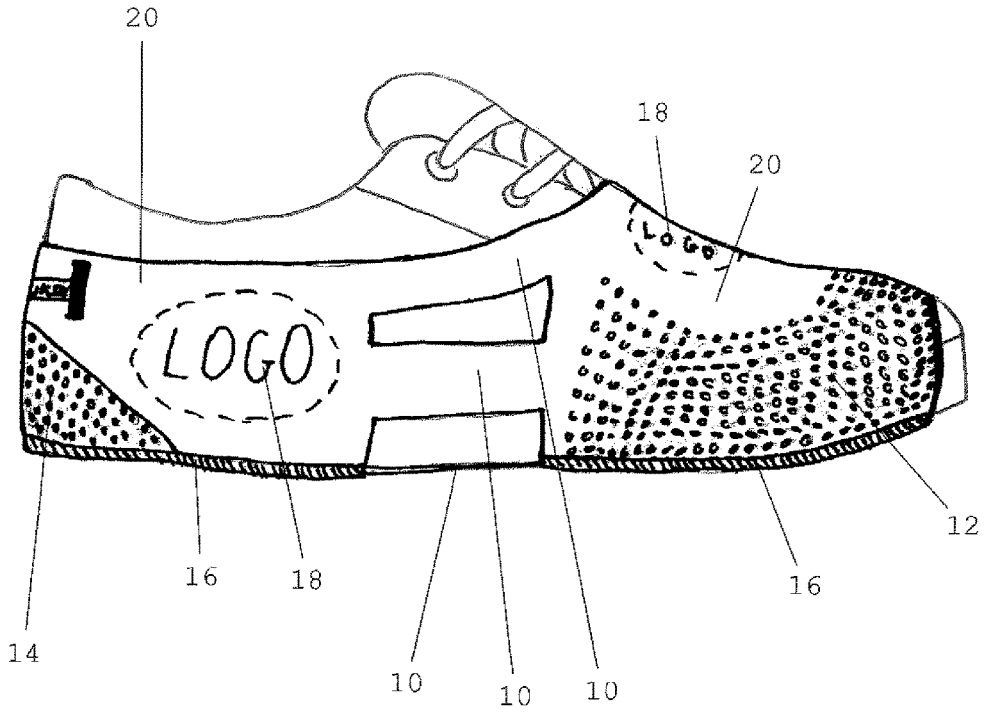
FIG. 1 is a right view of a flexible one size fits all overshoe that has added traction on the upper and sole showing the design. This overshoe is symmetrical on both right and left sides so the left view would be the same as FIG. 1.

FIG. 1 depicts a right sided view of a removable and reusable one piece design flexible one size fits all overshoe 20 that has a dynamic stretch banded mid foot construction 10 which allows the overshoe to flex or stretch to any size shoe in addition to added traction 12 on the upper front, added traction 14 on the upper rear and added traction and cushioning 16 on the sole showing the design. (Note: for the purpose of this disclosure and the appended claims, a heel is deemed as part of the sole) This depiction of the right side will be assumed the same as the left side view since the design of said overshoe is symmetrical (the same design on both sides).

Figure 2:
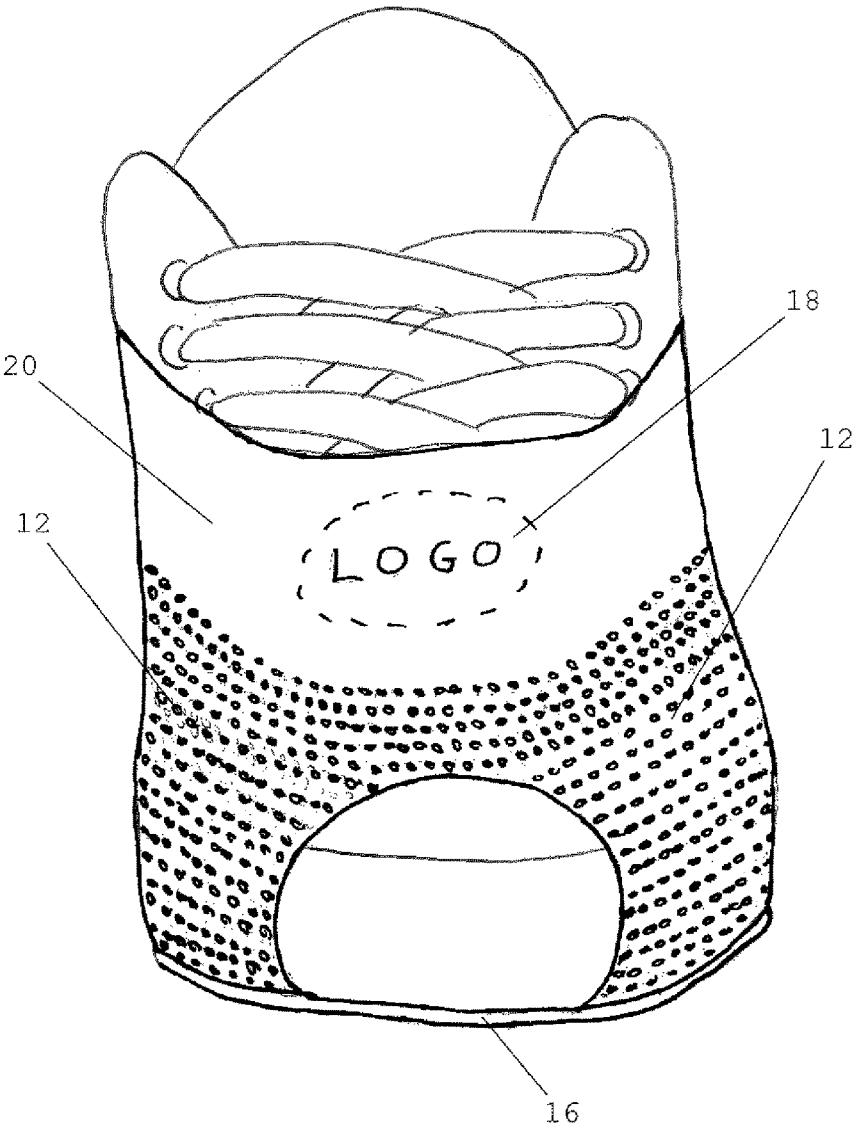
FIG. 2 is a front view of a flexible overshoe thereof.

FIG. 2 is a front view of a one piece design flexible overshoe 20 showing the added traction 12 on the upper front as well as on the upper rear and added traction and cushioning 16 on the sole thereof.

Figure 3:
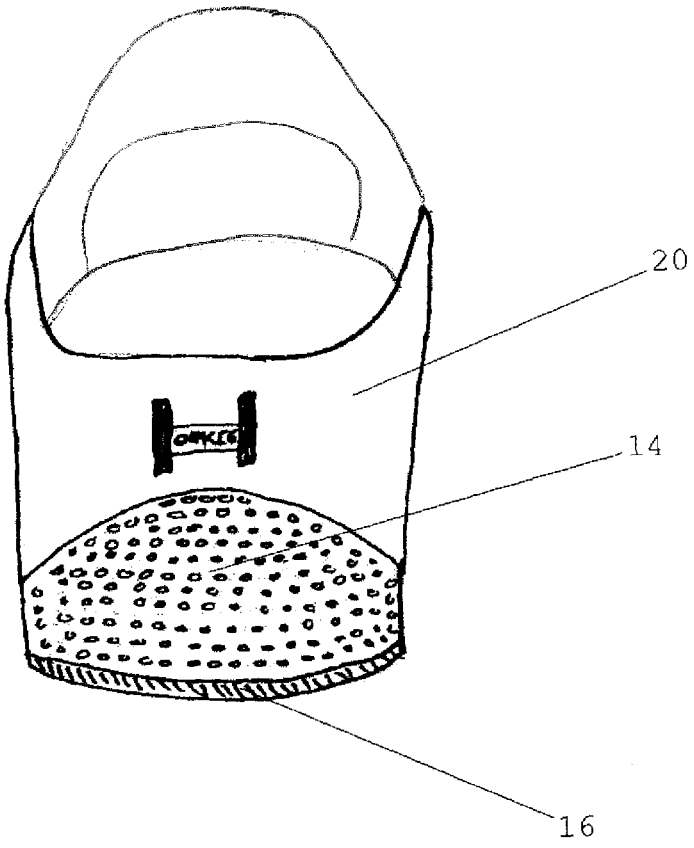
FIG. 3 is a rear view of a flexible overshoe thereof.

FIG. 3 is a rear view of a one piece design flexible overshoe 20 showing the added traction 14 on the upper rear as well as added traction and cushioning 16 on the sole thereof.

Figure 4:
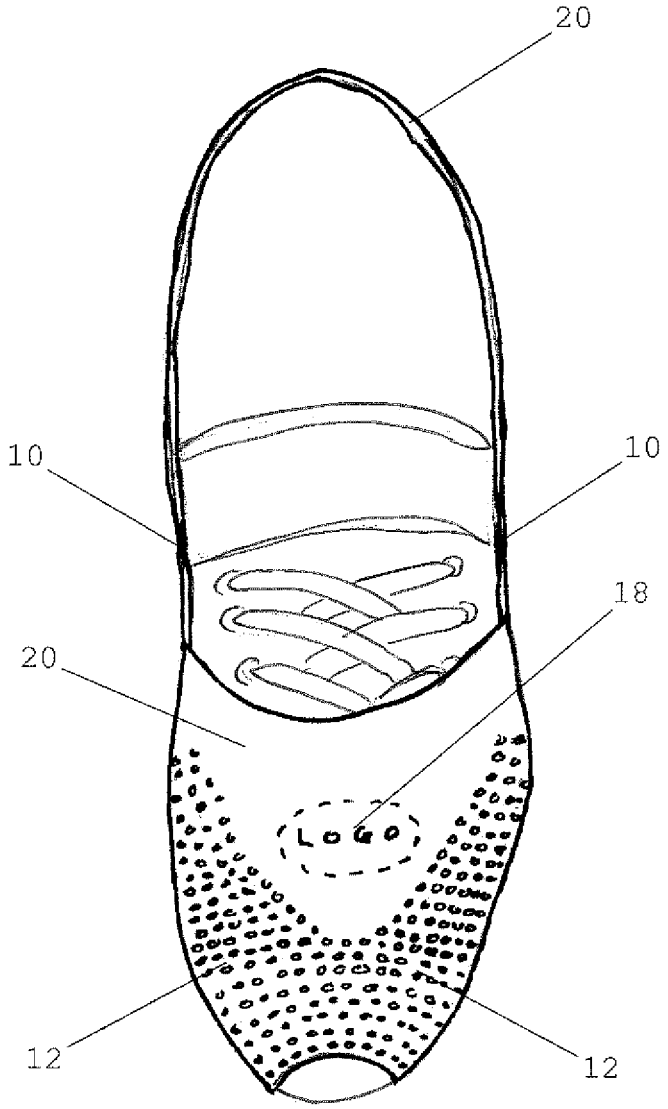
FIG. 4 is a top view of a flexible overshoe thereof.

FIG. 4 is a top view of a one piece flexible overshoe 20 that has banded mid foot construction 10 which allows the overshoe to flex or stretch to any size shoe in addition to added traction 12 on the upper front thereof.

Figure 5:
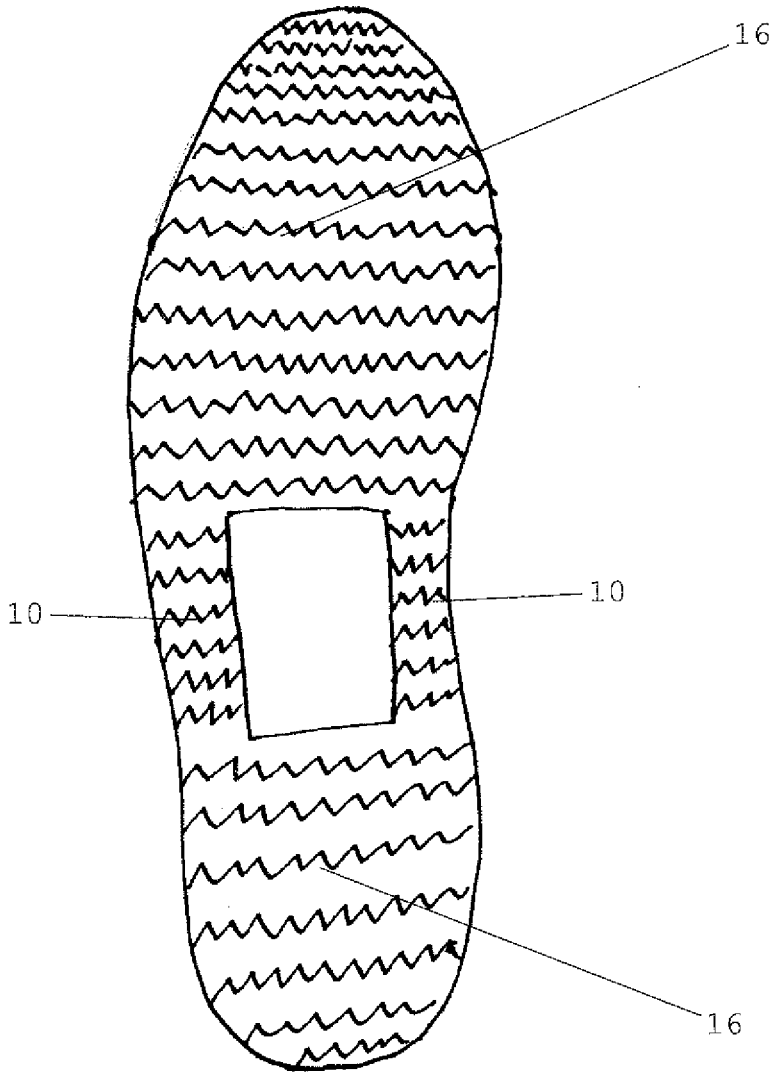
FIG. 5 is a bottom view of a flexible overshoe thereof.

FIG. 5 is a bottom view of a one piece flexible overshoe's 20 added traction and cushioning 16 on the sole thereof.

With reference to FIG. 1, the one piece design flexible overshoe has a unitarily molded upper potion 20 and a lower portion or sole 16. The upper portion 20 is a solid flexible rubber material and adapted to receive and fit any size or shape of shoe and to secure sole to shoe. The desired thickness of the upper portion is 0.5 mm to 5 mm. This thickness allows for the flexibility to stretch and conform to the shoe as well as durability. However, other thickness can be used. Upper portion is not restricted to a rubber material or solid construction. Other materials such as nylon, leather, canvas, etc. can be used. It is preferred that the material be flexible to facilitate placement over and removal from the shoe. The outer top and sidewalls of the upper at the ball area and heel area have a friction enhanced pattern formed to add protection and increase traction. Other top and sidewall designs such as a completely flat surface, raised or depressed areas, etc. can be used in the alternative if desired. In the center of the upper portion of the overshoe, there is a dynamic stretch banded mid foot construction 10 which allows the overshoe to flex or stretch to any size shoe. Other forms of construction can be utilized to allow the upper portion to be stretched or expanded to fit any size shoe such as density of the area, alternative materials, etc. if so desired. The bottom or sole portion of the overshoe 16 is permanently affixed or unitarily molded to the upper portion completing the one piece design. The bottom or sole portion of the overshoe 16 is a solid flexible rubber material in the shape of a conventional shoe bottom, i.e. sole of a sneaker, with added traction in the form of a friction enhanced pattern. The desired thickness of the bottom portion is 1 mm to 9 mm. This thickness allows for the flexibility to stretch where needed and allow durability and cushioning to the sole. However, other thickness can be used. In the center of the sole there is a dynamic stretch banded mid foot construction 10 which allows the overshoe to flex or stretch to any size shoe.

Other forms of construction can be utilized to allow the bottom portion to be stretched or expanded to fit any size shoe such as density of the area, alternative materials, etc. if so desired. Other bottom designs such as a completely flat surface, raised or depressed areas, etc. can be used in the alternative if desired. There is also and area on the upper portion 20 that can accept a logo 18 of any company wishing to add this to the overshoe. These areas 18 are optional and can be placed in any other area if desired. This depiction of the right side will be assumed the same as the left side view since the design of said overshoe is symmetrical (the same design on both sides).

This one piece construction is the most durable and desired form of construction for this invention however a combination of pieces can be put together to achieve a similar result.

FIG. 2 depicts the front view of the overshoe showing the one piece construction upper potion 20 and a lower portion or sole 16. FIG. 2 shows an area in the very front or tip of the overshoe that is open allowing a small portion of the shoe to be exposed. This design allows the upper portion 20 to be better form fitting to the shoe and discourage any unnecessary bumps or wrinkles in the upper portion of the overshoe. Other designs such as a completely closed toe or shape and size of the opening can be used is so desired. The height of the upper 20 on the shoe is meant to cover the area of the shoe's laces that are damaged skateboarding.

FIG. 3 depicts a rear view of the one piece design flexible overshoe 20 showing the added traction 14 on the upper rear as well as added traction and cushioning 16 on the sole.

FIG. 4 depicts a top view of a one piece flexible overshoe 20 that has banded mid foot construction 10 which allows the overshoe to flex or stretch to any size shoe in addition to added traction 12 on the upper front. Also shown is an area in the very front or tip of the overshoe that is open allowing a small portion of the shoe to be exposed. This design allows the upper portion 20 to be better form fitting to the shoe and discourage any unnecessary bumps or wrinkles in the upper portion of the overshoe. Other designs such as a completely closed toe or shape and size of the opening can be used is so desired. The height of the upper 20 on the shoe is meant to cover the area of the shoe's laces that are damaged by skateboarding.

FIG. 5 depicts a bottom view of a one piece flexible overshoe's 20 added traction and cushioning 16 on the sole. The bottom or sole portion of the overshoe 16 is permanently affixed to the upper potion completing the one piece design. The bottom or sole portion of the overshoe 16 is a solid flexible rubber material in the shape of a conventional shoe bottom, i.e. sole of a sneaker, with added traction in the form of grooves or other raised bumps or shapes. The desired thickness of the bottom portion is 1 cm to 9 cm. This thickness allows for the flexibility to stretch where needed and allow durability and cushioning to the sole. However, other thickness can be used. In the center of the sole there is a dynamic stretch banded mid foot construction 10 which allows the overshoe to flex or stretch to any size shoe. Other forms of construction can be utilized to allow the bottom portion to be stretched or expanded to fit any size shoe such as density of the area, alternative materials, etc. if so desired. Other bottom designs such as a completely flat surface, raised or depressed areas, etc. can be used in the alternative if desired.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An overshoe for receiving a traditional shoe being worn on the foot of a person and being of a type having a sole, heel region, toe region and eyelet laces area, said shoe cover comprising:

a sole portion and an upper portion extending upwardly from said sole portion and defining a top opening configured to receive the traditional shoe into an interior area defined by said upper portion, said upper portion having a frontal area covering approximately a front half of the traditional shoe and the laces eyelet area thereof when the traditional shoe is situated in said interior area, said upper portion including a heel portion opposite said frontal area being configured to substantially cover a heel region of the traditional shoe when situated in said interior area;

wherein said sole portion is constructed of a solid, stretchable rubber material;

wherein said frontal area of said upper portion defines a toe opening configured to receive the toe region of the traditional shoe when situated in said interior area;

wherein said upper portion includes a mid-upper region situated between said frontal area and said heel portion and proximate said top opening, said mid-upper region including a stretch band configured to allow said upper portion to stretch so as to accommodate the traditional shoe being received in said interior area of said upper portion;

wherein said upper portion includes a mid-sole region situated between said frontal area and said heel portion and adjacent said sole portion, said mid-sole region including another stretch band being configured to allow said upper portion to stretch so as to accommodate the traditional shoe being received in said interior area of said upper portion;

wherein said stretch band associated with said mid-upper region is displaced from said another stretch band associated with said mid-sole region;

a plurality of front traction members extending outwardly from said frontal area of said upper portion, said traction members being situated on both sides of and above said toe opening;

a plurality of back traction members extending outwardly from said heel portion of said heel portion and adjacent said sole portion.

2. The overshoe as in claim 1, wherein said upper portion has a unitary construction of a material taken from a group comprising solid rubber, nylon, leather, and canvas, said upper portion having a thickness of about 0.5 mm to 5 mm that allows stretching and flexibility when the traditional shoe is received into said interior area.

3. The overshoe as in claim 2, wherein said sole portion has a thickness of about 1 mm to 9 mm.

4. The overshoe as in claim 3, wherein said sole portion includes a stretch banded area that allows said sole portion to flex when the traditional shoe is received in said interior area.

5. The overshoe as in claim 1, wherein said upper portion includes a logo area having indicia indicative of advertising, said indicia including alphanumeric, graphical, pictorial, photographic indicia or combinations thereof.

6. The overshoe as in claim 1, wherein said toe hole is configured to expose a toe area of the traditional shoe when received in said interior area of said upper portion.

7. The overshoe as in claim 1, wherein:

said stretch band extends longitudinally frontwardly and rearwardly relative to opposed ends of said upper portion;

said another stretch band extends longitudinally frontwardly and rearwardly relative to opposed ends of said upper portion.

8. The overshoe as in claim 7, wherein each of said stretch band and said another stretch band has a length in the range of about 1 cm to 8 cm.

9. The overshoe as in claim 8, wherein stretch band and said another stretch band each define a respective opening.

* * * * *